US010545423B2

(12) United States Patent
Komada

(10) Patent No.: US 10,545,423 B2
(45) Date of Patent: Jan. 28, 2020

(54) TONER

(71) Applicant: KYOCERA Document Solutions Inc., Osaka (JP)

(72) Inventor: Ryotaro Komada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/426,954

(22) Filed: May 30, 2019

(65) Prior Publication Data

US 2019/0377276 A1 Dec. 12, 2019

(30) Foreign Application Priority Data

Jun. 7, 2018 (JP) ..... 2018-109270

(51) Int. Cl.
*G03G 9/097* (2006.01)
*G03G 9/087* (2006.01)
*G03G 9/093* (2006.01)

(52) U.S. Cl.
CPC ..... *G03G 9/09716* (2013.01); *G03G 9/08726* (2013.01); *G03G 9/08791* (2013.01); *G03G 9/09725* (2013.01); *G03G 9/09321* (2013.01)

(58) Field of Classification Search
CPC ..... G03G 9/09716; G03G 9/09725; G03G 9/08791
See application file for complete search history.

(56) References Cited

U.S. PATENT DOCUMENTS

| | | | | |
|---|---|---|---|---|
| 5,102,763 | A * | 4/1992 | Winnik | G03G 9/08791 430/108.21 |
| 2010/0009277 | A1* | 1/2010 | Ogawa | G03G 9/09716 430/108.7 |
| 2017/0242360 | A1* | 8/2017 | Nishitera | G03G 9/09321 |
| 2017/0248860 | A1* | 8/2017 | Nishitera | G03G 9/09716 |
| 2018/0210357 | A1* | 7/2018 | Tsujihiro | G03G 9/09328 |
| 2019/0121252 | A1* | 4/2019 | Komada | G03G 9/09392 |

FOREIGN PATENT DOCUMENTS

| | | | |
|---|---|---|---|
| JP | 2005-321690 | A | 11/2005 |
| JP | 2010-198004 | A | 9/2010 |
| JP | 2012-203360 | A | 10/2012 |
| JP | 2018185426 | A * | 11/2018 |

OTHER PUBLICATIONS

English language machine translation of JP 2018-185426 (Year: 2018).*

* cited by examiner

*Primary Examiner* — Christopher D Rodee
(74) *Attorney, Agent, or Firm* — Studebaker & Brackett PC

(57) ABSTRACT

A toner includes toner particles each including a toner mother particle and an external additive adhering to a surface of the toner mother particle. The external additive includes silica particles. The silica particles each include a silica base, a first surface treatment layer covering the silica base, and a second surface treatment layer covering the first surface treatment layer. The first surface treatment layer contains a carboxy-modified silicone oil. The second surface treatment layer contains a specific copolymer including a first repeating unit represented by general formula (I) shown below and a second repeating unit represented by general formula (II) shown below.

(I)

(II)

The silica particles have a non-ring-opened oxazoline group content of at least 1 μmol/g and no greater than 500 μmol/g as measured by gas chromatography-mass spectrometry.

4 Claims, 2 Drawing Sheets

TONER

INCORPORATION BY REFERENCE

The present application claims priority under 35 U.S.C. § 119 to Japanese Patent Application No. 2018-109270, filed on Jun. 7, 2018. The contents of this application are incorporated herein by reference in their entirety.

BACKGROUND

The present disclosure relates to a toner.

A toner (particularly, an electrostatic latent image developing toner) may include an external additive in addition to toner mother particles. The external additive is caused to adhere to surfaces of the toner mother particles in order to impart fluidity and desired chargeability (for example, positive chargeability) to the toner. As an example of such an external additive, silica particles have been proposed which are formed by surface-treating silica bases with a silane coupling agent and/or a silicone oil.

SUMMARY

A toner according to an aspect of the present disclosure includes toner particles each including a toner mother particle and an external additive adhering to a surface of the toner mother particle. The external additive includes silica particles. The silica particles each include a silica base, a first surface treatment layer covering the silica base, and a second surface treatment layer covering the first surface treatment layer. The first surface treatment layer contains a carboxy-modified silicone oil. The second surface treatment layer contains a specific copolymer including a first repeating unit represented by general formula (I) shown below and a second repeating unit represented by general formula (II) shown below. The silica particles have a non-ring-opened oxazoline group content of at least 1 μmol/g and no greater than 500 μmol/g as measured by gas chromatography-mass spectrometry.

(I)

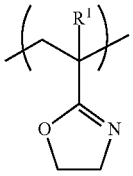

(II)

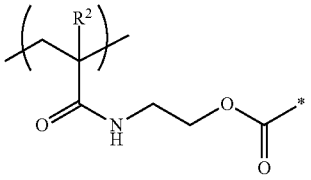

In general formula (I), $R^1$ represents a hydrogen atom or an alkyl group having a carbon number of at least 1 and no greater than 10 and optionally substituted with a phenyl group.

In general formula (II), $R^2$ represents a hydrogen atom or an alkyl group having a carbon number of at least 1 and no greater than 10 and optionally substituted with a phenyl group. An asterisk in general formula (II) represents a site that is bonded to an atom in the carboxy-modified silicone oil.

DETAILED DESCRIPTION

Figure 1:
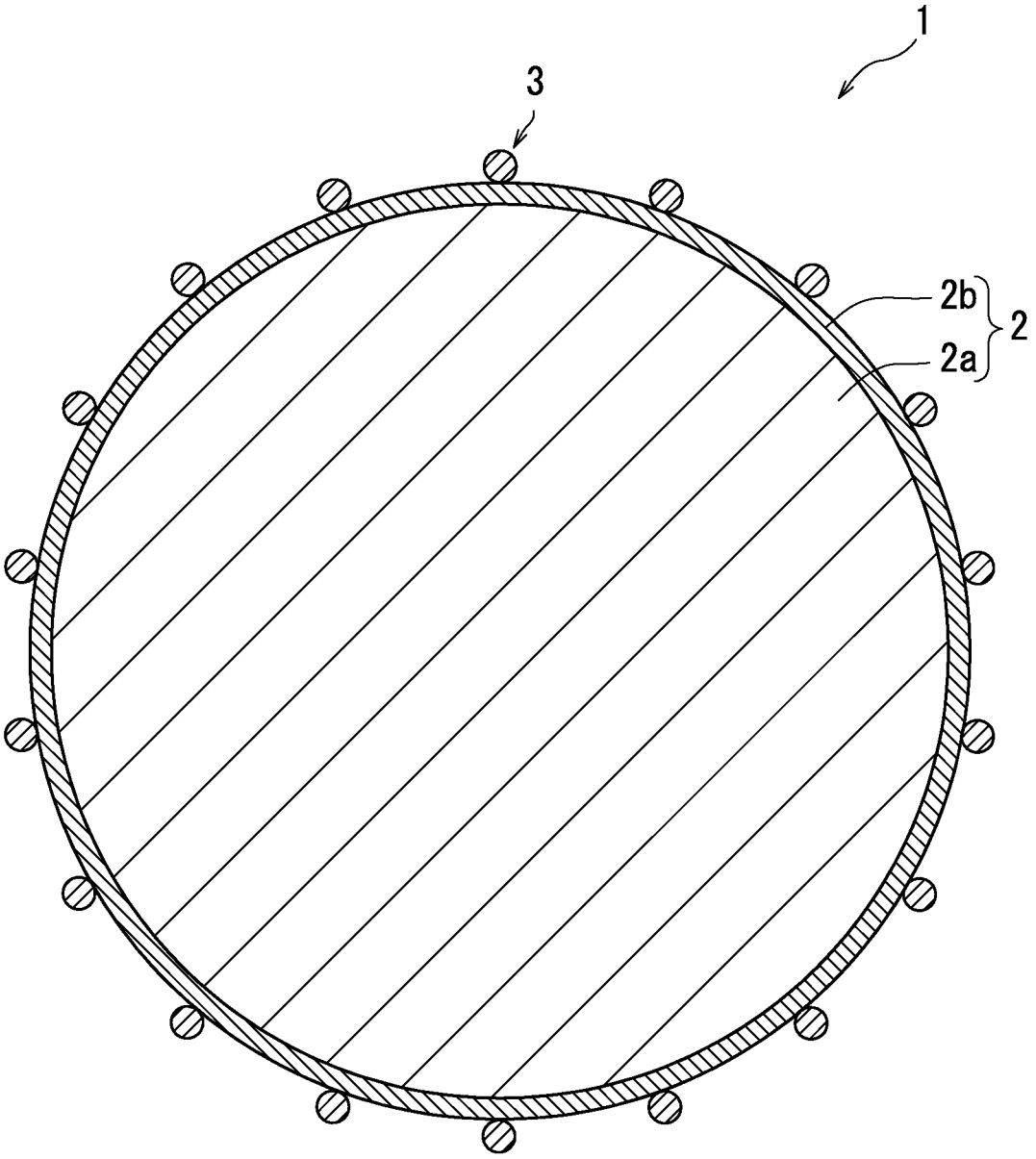
FIG. 1 is a cross-sectional view schematically illustrating an example of a toner according to a first embodiment of the present disclosure.

The following describes preferred embodiments of the present disclosure. A toner is a collection (for example, a powder) of toner particles. An external additive is a collection (for example, a powder) of external additive particles. Unless otherwise stated, evaluation results (for example, values indicating shape and physical properties) for a powder (specific examples include a powder of toner particles and a powder of external additive particles) are each a number average of values measured for a suitable number of particles selected from the powder.

A value for volume median diameter ($D_{50}$) of a powder is measured using a laser diffraction/scattering particle size distribution analyzer ("LA-950", product of Horiba, Ltd.), unless otherwise stated.

A number average primary particle diameter of a powder is a number average of equivalent circle diameters of primary particles (Heywood diameter: diameters of circles having the same areas as projected areas of the primary particles) measured using a scanning electron microscope, unless otherwise stated. A number average primary particle diameter of a powder is for example a number average of equivalent circle diameters of 100 primary particles of the powder. Note that a number average primary particle diameter of a powder refers to a number average primary particle diameter of particles in the powder, unless otherwise stated.

Chargeability refers to chargeability in triboelectric charging, unless otherwise stated. Strength of positive chargeability (or strength of negative chargeability) in triboelectric charging can be confirmed from a known triboelectric series or the like. A measurement target (for example, a toner) is triboelectrically charged for example by mixing and stirring the measurement target with a standard carrier (N-01: a standard carrier for a negatively chargeable toner, P-01: a standard carrier for a positively chargeable toner) provided by The Imaging Society of Japan. An amount of charge of the measurement target is measured before and after the triboelectric charging using for example a charge meter (Q/m meter). A measurement target having a larger change in amount of charge before and after the triboelectric charging has stronger chargeability.

A value for a softening point (Tm) is measured using a capillary rheometer ("CFT-500D", product of Shimadzu Corporation), unless otherwise stated. On an S-shaped curve (horizontal axis: temperature, vertical axis: stroke) plotted using the capillary rheometer, the softening point (Tm) is a temperature corresponding to a stroke value of "(base line stroke value+maximum stroke value)/2".

A value for a glass transition point (Tg) is measured in accordance with "Japanese Industrial Standard (JIS) K7121-2012" using a differential scanning calorimeter ("DSC-6220", product of Seiko Instruments Inc.), unless otherwise stated. On a heat absorption curve (vertical axis: heat flow (DSC signal), horizontal axis: temperature) plotted using the differential scanning calorimeter, a temperature at a point of inflection caused due to glass transition (specifically, a temperature at an intersection point between an extrapolation of a base line and an extrapolation of an inclined portion of the curve) corresponds to the glass transition point (Tg).

The term "main component" of a material used herein refers to a component that accounts for the largest proportion of the mass of the material, unless otherwise stated.

Strength of hydrophobicity (or strength of hydrophilicity) can for example be indicated by a contact angle with respect to a water droplet (water wettability). A larger contact angle with respect to a water droplet indicates stronger hydrophobicity.

Hereinafter, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" may be used as a generic term for both acryl and methacryl.

An alkyl group having a carbon number of at least 1 and no greater than 10, an alkyl group having a carbon number of at least 1 and no greater than 5, an alkyl group having a carbon number of at least 1 and no greater than 3, and an alkanediyl group having a carbon number of at least 1 and no greater than 10 each refer to the following unless otherwise stated. An alkyl group having a carbon number of at least 1 and no greater than 10, an alkyl group having a carbon number of at least 1 and no greater than 5, an alkyl group having a carbon number of at least 1 and no greater than 3, and an alkanediyl group having a carbon number of at least 1 and no greater than 10 are each a unsubstituted straight chain or branched chain group. Examples of alkyl groups having a carbon number of at least 1 and no greater than 10 include a methyl group, an ethyl group, an n-propyl group, an isopropyl group, an n-butyl group, a sec-butyl group, a tert-butyl group, an n-pentyl group, an isopentyl group, a neopentyl group, a 1,2-dimethylpropyl group, a straight chain or branched chain hexyl group, a straight chain or branched chain heptyl group, a straight chain or branched chain octyl group, a straight chain or branched chain nonyl group, and a straight chain or branched chain decyl group. Examples of alkyl groups having a carbon number of at least 1 and no greater than 5 and alkyl groups having a carbon number of at least 1 and no greater than 3 include the chemical groups having a carbon number of at least 1 and no greater than 5, and the chemical groups having a carbon number of at least 1 and no greater than 3 out of the chemical groups listed as examples of alkyl groups having a carbon number of at least 1 and no greater than 10. Examples of alkanediyl groups having a carbon number of at least 1 and no greater than 10 include chemical groups obtained by removal of one hydrogen atom from the chemical groups listed as examples of alkyl groups having a carbon number of at least 1 and no greater than 10.

First Embodiment: Toner

A first embodiment of the present disclosure relates to a toner. The toner according to the first embodiment includes toner particles each including a toner mother particle and an external additive adhering to a surface of the toner mother particle. The external additive includes silica particles. The silica particles each include a silica base, a first surface treatment layer covering the silica base, and a second surface treatment layer covering the first surface treatment layer. The first surface treatment layer contains a carboxy-modified silicone oil. The second surface treatment layer contains a specific copolymer (also referred to below as a first copolymer) including a first repeating unit represented by general formula (I) shown below and a second repeating unit represented by general formula (II) shown below. The silica particles have a non-ring-opened oxazoline group content of at least 1 μmol/g and no greater than 500 μmol/g as measured by gas chromatography-mass spectrometry.

(I)

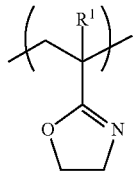

(II)

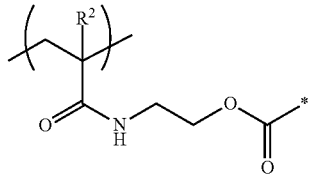

In general formula (I), $R^1$ represents a hydrogen atom or an alkyl group having a carbon number of at least 1 and no greater than 10 and optionally substituted with a phenyl group.

In general formula (II), $R^2$ represents a hydrogen atom or an alkyl group having a carbon number of at least 1 and no greater than 10 and optionally substituted with a phenyl group. An asterisk in general formula (II) represents a site that is bonded to an atom in the carboxy-modified silicone oil.

Preferably, $R^1$ and $R^2$ each represent, independently of one another, a hydrogen atom, a methyl group, an ethyl group, or an isopropyl group.

[Toner Particles]

FIG. 1 illustrates an example of a toner particle 1 included in the toner according to the first embodiment. The toner particle 1 illustrated in FIG. 1 includes a toner mother particle 2 and an external additive 3 adhering to a surface of the toner mother particle 2. The external additive 3 includes silica particles. That is, at least a portion of particles of the external additive 3 illustrated in FIG. 1 is silica particles. The toner mother particle 2 has a toner core 2*a* and a shell layer 2*b* covering the toner core 2*a*. However, the toner particles included in the toner according to the first embodiment may have a different structure from the toner particle 1 illustrated in FIG. 1 so long as the toner particles each include a toner mother particle and an external additive adhering to a surface of the toner mother particle.

Figure 2:
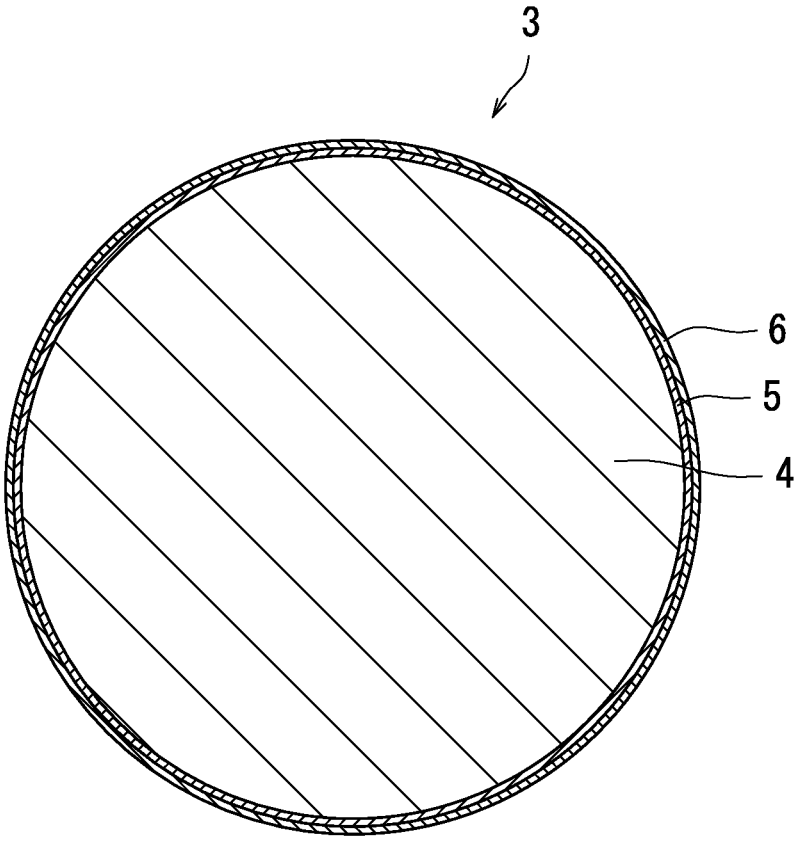
FIG. 2 is a cross-sectional view schematically illustrating an example of a silica particle included in an external additive of the toner illustrated in FIG. 1.

FIG. 2 illustrates an example of the silica particles included in the external additive 3. The silica particles each include a silica base 4, a first surface treatment layer 5 covering the silica base 4, and a second surface treatment layer 6 covering the first surface treatment layer 5. The first surface treatment layer 5 contains a carboxy-modified silicone oil. The second surface treatment layer 6 contains the first copolymer including the first repeating unit represented by general formula (I) shown above and the second repeating unit represented by general formula (II) shown above. The silica particles have a non-ring-opened oxazoline group content of at least 1 μmol/g and no greater than 500 μmol/g as measured by gas chromatography-mass spectrometry.

Having the above-described features, the toner according to the first embodiment is excellent in anti-fogging performance, thermal-stress resistance, and charge stability. The following explains the reasons for the above. In each silica particle, the first copolymer contained in the second surface treatment layer 6 includes a specific amount of a non-ring-opened oxazoline group having relatively strong positive chargeability. This non-ring-opened oxazoline group negates hydrophilicity and negative chargeability attributed to a silanol group of the silica base. Thus, the silica particles can impart fluidity to the toner without impairing thermal-stress resistance and chargeability (particularly, positive chargeability) of the toner. In each silica particle, furthermore, silica contained as a main component of the silica base 4 and the carboxy-modified silicone oil contained in the first surface treatment layer 5 have high affinity for each other, and the carboxy-modified silicone oil contained in the first surface treatment layer 5 and the first copolymer contained in the second surface treatment layer 6 are crosslinked with each other. As a result, each silica particle has high adhesion between the silica base 4 and the first surface treatment layer 5, and high adhesion between the first surface treatment layer 5 and the second surface treatment layer 6, preventing easy detachment of the second surface treatment layer 6. Since the second surface treatment layers 6 are prevented from being detached from the silica particles, the toner according to the first embodiment can maintain its chargeability even if the toner is stressed for example through low-density printing. Thus, the toner according to the first embodiment can inhibit fogging from occurring due to a charge potential change.

The non-ring-opened oxazoline group included in a material (a second copolymer described below) of the first copolymer is reactive with carboxy groups rather than with silanol groups in silica. The second surface treatment layer 6 can therefore be prevented from being detached from the silica particle more effectively in a structure in which the second surface treatment layer 6 covers the silica base 4 with the first surface treatment layer 5 therebetween than in a structure in which the second surface treatment layer 6 directly covers the silica base 4.

A toner according to the first embodiment can for example be favorably used as a positively chargeable toner in development of electrostatic latent images. The toner according to the first embodiment may be used as a one-component developer. Alternatively, a two-component developer may be prepared by mixing the toner according to the first embodiment and a carrier using a mixer (for example, a ball mill). In a situation in which the toner according to the first embodiment is used as a one-component developer, the toner is positively charged through friction with a development sleeve or a toner charging member in a developing device. The toner charging member is for example a doctor blade. In a situation in which the toner according to the first embodiment is included in a two-component developer, the toner is positively charged through friction with the carrier in the developing device.

Through the above, the toner particle 1 included in the toner according to the first embodiment has been described in detail based on FIGS. 1 and 2. The following describes the toner particles in further detail. Note that one material may be used independently, or two or more materials may be used in combination as each of components described below, unless otherwise stated.

[External Additive]

The external additive includes silica particles. The external additive may include an additional external additive other than the silica particles. The external additive particles preferably have a number average primary particle diameter of at least 5 nm and no greater than 50 nm, and more preferably at least 10 nm and no greater than 35 nm.

(Silica Particles)

The silica particles each include a silica base, a first surface treatment layer covering the silica base, and a second surface treatment layer covering the first surface treatment layer. The silica particles have a non-ring-opened oxazoline group content of at least 1 μmol/g and no greater than 500 μmol/g, preferably at least 20 μmol/g and no greater than 460 μmol/g, more preferably at least 20 μmol/g and no greater than 420 μmol/g, and still more preferably at least 20 μmol/g and no greater than 350 μmol/g.

[Silica Base]

No particular limitations are placed on the silica base, and for example hydrophilic fumed silica can be used as the silica base. The silica base for example has a specific surface area of at least 70 $m^2/g$ and no greater than 120 $m^2/g$.

(First Surface Treatment Layer)

The first surface treatment layer contains a carboxy-modified silicone oil. The first surface treatment layer preferably has a carboxy-modified silicone oil content of at least 80% by mass, more preferably 95% by mass, and still more preferably 100% by mass.

The carboxy-modified silicone oil may have a carboxy group at a side chain, at one end, or at both ends.

The carboxy-modified silicone oil having a carboxy group at a side chain is for example a compound represented by general formula (1) shown below. Some or all of the carboxy groups in a molecule of the compound represented by general formula (1) may be crosslinked with the first copolymer described below.

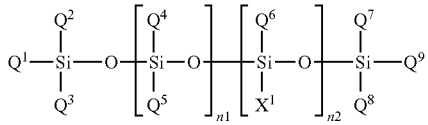

(1)

In general formula (1), $Q^1$ to $Q^9$ each represent, independently of one another, an alkyl group. $X^1$ represents $-L^1COOH$. $L^1$ represents an alkanediyl group. n1 and n2 each represent, independently of one another, an integer of at least 1.

Preferably, $Q^1$ to $Q^9$ each represent, independently of one another, an alkyl group having a carbon number of at least 1 and no greater than 5, and more preferably a methyl group.

Preferably, $L^1$ represents an alkanediyl group having a carbon number of at least 1 and no greater than 10.

Preferably, n1 and n2 each represent, independently of one another, an integer of at least 1 and no greater than 100, and more preferably an integer of at least 10 and no greater than 100.

A commercially available carboxy-modified silicone oil having a carboxy group at a side chain may be used, such as "X-22-3701E", product of Shin-Etsu Chemical Co., Ltd.

The "X-22-3701E" of Shin-Etsu Chemical Co., Ltd. is represented by general formula (1) in which $Q^1$ to $Q^9$ each represent a methyl group.

The carboxy-modified silicone oil having a carboxy group at one end is for example a compound represented by general formula (2) shown below. The carboxy group in a molecule of the compound represented by general formula (2) may be crosslinked with the first copolymer described below.

(2)

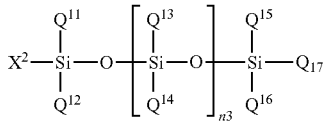

In general formula (2), $Q^{11}$ to $Q^{17}$ each represent, independently of one another, an alkyl group. $X^2$ represents $-L^2COOH$. $L^2$ represents an alkanediyl group. n3 represents an integer of at least 1.

Preferably, $Q^{11}$ to $Q^{17}$ each represent, independently of one another, an alkyl group having a carbon number of at least 1 and no greater than 5, and more preferably a methyl group.

Preferably, $L^2$ represents an alkanediyl group having a carbon number of at least 1 and no greater than 10.

Preferably, n3 represents an integer of at least 1 and no greater than 100, and more preferably an integer of at least 10 and no greater than 100.

A commercially available carboxy-modified silicone oil having a carboxy group at one end may be used, such as "X-22-3710", product of Shin-Etsu Chemical Co., Ltd. The "X-22-3710" of Shin-Etsu Chemical Co., Ltd. is represented by general formula (2) in which $Q^{11}$ to $Q^{17}$ each represent a methyl group.

The carboxy-modified silicone oil having a carboxy group at both ends is for example a compound represented by general formula (3) shown below. One or both of the carboxy groups in a molecule of the compound represented by general formula (3) may be crosslinked with the first copolymer described below.

(3)

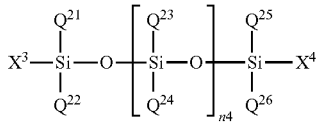

In general formula (3), to $Q^{31}$ to $Q^{26}$ each represent, independently of one another, an alkyl group. $X^3$ and $X^4$ each represent, independently of one another, $-L^3COOH$. $L^3$ represents an alkanediyl group. n4 represents an integer of at least 1.

Preferably, $Q^{21}$ to $Q^{26}$ each represent, independently of one another, an alkyl group having a carbon number of at least 1 and no greater than 5, and more preferably a methyl group.

Preferably, $L^3$ represents an alkanediyl group having a carbon number of at least 1 and no greater than 10.

Preferably, n4 represents an integer of at least 1 and no greater than 100, and more preferably an integer of at least 10 and no greater than 100.

A commercially available carboxy-modified silicone oil having a carboxy group at both ends may be used, such as "X-22-162C", product of Shin-Etsu Chemical Co., Ltd. The "X-22-162C" of Shin-Etsu Chemical Co., Ltd. is represented by general formula (3) in which $Q^{21}$ to $Q^{26}$ each represent a methyl group.

(Second Surface Treatment Layer)

The second surface treatment layer contains the first copolymer including the first repeating unit represented by general formula (I) and the second repeating unit represented by general formula (II). The second surface treatment layer preferably has a first copolymer content of at least 80% by mass, more preferably at least 95% by mass, and still more preferably 100% by mass.

The first copolymer may further include a repeating unit derived from an additional vinyl compound. Examples of additional vinyl compounds that can be used include ethylene, propylene, butadiene, vinyl chloride, (meth)acrylic acid, a (meth)acrylic acid ester, acrylonitrile, and styrene. The (meth)acrylic acid ester is preferably an alkyl (meth) acrylate, more preferably methyl (meth)acrylate or ethyl (meth)acrylate, and still more preferably methyl methacrylate. Preferably, the first copolymer further includes a repeating unit derived from an alkyl (meth)acrylate (also referred to below as a third repeating unit).

The first copolymer may further include a fourth repeating unit represented by general formula (III) shown below.

(III)

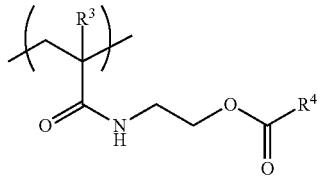

In general formula (III), $R^3$ represents a hydrogen atom or an alkyl group having a carbon number of at least 1 and no greater than 10 and optionally substituted with a phenyl group. $R^4$ represents an alkyl group having a carbon number of at least 1 and no greater than 3.

Preferably, $R^3$ represents a hydrogen atom, a methyl group, an ethyl group, or an isopropyl group.

Preferably, $R^4$ represents a methyl group or an ethyl group.

Preferably, the first copolymer is a copolymer including the first repeating unit, the second repeating unit, and the third repeating unit. More preferably, the first copolymer is a copolymer only including the first repeating unit, the second repeating unit, and the third repeating unit, or a copolymer only including the first repeating unit, the second repeating unit, the third repeating unit, and the fourth repeating unit.

Preferably, the toner particles have a silica particle content of at least 0.1 parts by mass and no greater than 10.0 parts by mass relative to 100 parts by mass of the toner mother particles, and more preferably at least 0.5 parts by mass and no greater than 5.0 parts by mass.

The additional external additive is preferably inorganic particles, more preferably silica particles other than the above-described silica particles, or particles of a metal oxide (specific examples include alumina, titanium oxide, magnesium oxide, zinc oxide, strontium titanate, and barium titanate), and still more preferably titanium oxide particles. Alternatively or additionally, particles of an organic acid compound such as a fatty acid metal salt (specific examples include zinc stearate) or resin particles may be used as the external additive.

In terms of allowing the external additive to sufficiently exhibit its function while inhibiting detachment of the external additive from the toner mother particles, the additional external additive is preferably contained in an amount of at least 0.1 parts by mass and no greater than 15.0 parts by mass relative to 100 parts by mass of the toner mother particles of the toner particles, and more preferably at least 1.0 part by mass and no greater than 5.0 parts by mass.

[Toner Mother Particle]

The toner mother particle of the toner particle described with reference to FIG. 1 includes a toner core and a shell layer covering the surface of the toner core. Such a toner particle is also referred to below as a capsule toner particle. The shell layer is substantially composed of a resin. The shell layer may be substantially composed of a thermosetting resin, may be substantially composed of a thermoplastic resin, or may contain both a thermosetting resin and a thermoplastic resin. Both heat-resistant preservability and low-temperature fixability of the toner can be achieved for example by using low-melting toner cores and covering each toner core with a highly heat-resistant shell layer. An additive may be dispersed in the resin forming the shell layer. The shell layer entirely covers the surface of the toner core in FIG. 1. However, the shell layer is not limited as such and may partially cover the surface of the toner core. The shell layer of the toner mother particle is optional. That is, the toner core that is not covered with the shell layer may be used as is as a toner mother particle.

In the case of the capsule toner particles, each shell layer preferably has a thickness of at least 1 nm and no greater than 400 nm in terms of improving heat-resistant preservability of the toner while maintaining low-temperature fixability of the toner. The thickness of the shell layer can be measured by dying the toner particle and analyzing a transmission electron microscope (TEM) image of a cross-section of the dyed toner particle using commercially available image analysis software (for example, "WinROOF", product of Mitani Corporation). Note that if the thickness of the shell layer is not uniform for a single toner particle, the thickness of the shell layer is measured at each of four locations that are approximately evenly spaced and the arithmetic mean of the four measured values is determined to be an evaluation value (the thickness of the shell layer) for the toner particle. Specifically, the four measurement locations are determined by drawing two straight lines that intersect at right angles at approximately the center of the cross-section of the toner particle and determining four locations at which the two straight lines and the shell layer intersect to be the measurement locations.

In the case of the capsule toner particles, preferably, at least 90% and no greater than 100% of the surface area of the toner core is covered with the shell layer (shell layer coverage ratio). More preferably, at least 95% and no greater than 100% of the surface area of the toner core is covered with the shell layer. As a result of each shell layer covering at least 90% of the surface area of the corresponding toner core, the toner can have further improved heat-resistant preservability. The shell layer coverage ratio can be measured by analyzing transmission electron microscope (TEM) images of cross-sections of the toner particles using commercially available image analysis software (for example, "WinROOF", product of Mitani Corporation). Specifically, in a TEM image of a cross-section of a dyed toner particle, the shell layer coverage ratio can be obtained by measuring a percentage of an area covered with the shell layer out of the surface area of the toner core (an area defined by an outline representing a periphery of the toner core).

In terms of forming high-quality images, the toner mother particles preferably have a volume median diameter ($D_{50}$) of at least 4 μm and no greater than 9 μm.

[Toner Core]

The toner cores for example contain a binder resin as a main component. The toner cores may contain an internal additive (for example, at least one of a colorant, a releasing agent, a charge control agent, and a magnetic powder) as necessary in addition to the binder resin.

(Binder Resin)

In terms of providing a toner having excellent low-temperature fixability, the toner cores preferably contain a thermoplastic resin as the binder resin. More preferably, the thermoplastic resin contained in the toner cores accounts for at least 85% by mass of a total mass of the binder resin. Examples of thermoplastic resins that can be used include styrene-based resins, acrylic acid ester-based resins, olefin-based resins (specific examples include polyethylene resins and polypropylene resins), vinyl resins (specific examples include vinyl chloride resins, polyvinyl alcohol, vinyl ether resins, and N-vinyl resins), polyester resins, polyamide resins, and urethane resins. Furthermore, copolymers of the resins listed above, that is, copolymers obtained through incorporation of a repeating unit into any of the resins listed above (specific examples include styrene-acrylic acid ester-based resins and styrene-butadiene-based resins) may be used as the binder resin.

A thermoplastic resin can be obtained through addition polymerization, copolymerization, or polycondensation of at least one thermoplastic monomer. Note that the thermoplastic monomer means a monomer that forms a thermoplastic resin through homopolymerization (specific examples include acrylic acid ester-based monomers and styrene-based monomers) or a monomer that forms a thermoplastic resin through polycondensation (for example, a combination of a polyhydric alcohol and a polycarboxylic acid that form a polyester resin through polycondensation).

In terms of providing a toner having excellent low-temperature fixability, the toner cores preferably contain a polyester resin as the binder resin. A polyester resin is obtained through polycondensation of at least one polyhydric alcohol and at least one polycarboxylic acid. Examples of alcohols that can be used for synthesis of the polyester resin include dihydric alcohols (specific examples include diols and bisphenols) and tri- or higher-hydric alcohols listed below. Examples of carboxylic acids that can be used for synthesis of the polyester resin include dibasic carboxylic acids and tri- or higher-basic carboxylic acids listed below. Note that a derivative of a polycarboxylic acid that can form an ester bond through polycondensation, such as a polycarboxylic acid anhydride or a polycarboxylic acid halide, may be used instead of a polycarboxylic acid.

Examples of preferable diols include ethylene glycol, diethylene glycol, triethylene glycol, 1,2-propanediol, 1,3-propanediol, 1,4-butanediol, neopentyl glycol, 2-butene-1,4-diol, 1,5-pentanediol, 2-pentene-1,5-diol, 1,6-hexanediol, 1,4-cyclohexanedimethanol, dipropylene glycol, 1,4-benzenediol, polyethylene glycol, polypropylene glycol, and polytetramethylene glycol.

Examples of preferable bisphenols include bisphenol A, hydrogenated bisphenol A, bisphenol A ethylene oxide adducts, and bisphenol A propylene oxide adducts.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable di-basic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Examples of preferable tri- and higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, 1,2,4-cyclohexanetricarboxylic acid, tetra(methylenecarboxy)methane, 1,2,7,8-octanetetracarboxylic acid, pyromellitic acid, and EMPOL trimer acid.

(Colorant)

The toner cores may contain a colorant. The colorant can be a commonly known pigment or dye that matches the color of the toner. In terms of forming high-quality images using the toner, the colorant is preferably contained in an amount of at least 1 part by mass and no greater than 20 parts by mass relative to 100 parts by mass of the binder resin.

The toner cores may contain a black colorant. The black colorant is for example carbon black. A colorant that is adjusted to a black color using a yellow colorant, a magenta colorant, and a cyan colorant can be used as a black colorant.

The toner cores may contain a non-black colorant. The non-black colorant is for example a yellow colorant, a magenta colorant, or a cyan colorant.

The yellow colorant that can be used is for example at least one compound selected from the group consisting of condensed azo compounds, isoindolinone compounds, anthraquinone compounds, azo metal complexes, methine compounds, and arylamide compounds. Examples of yellow colorants that can be used include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C. I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be used include C. I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

The cyan colorant that can be used is for example at least one compound selected from the group consisting of copper phthalocyanine compounds, anthraquinone compounds, and basic dye lake compounds. Examples of cyan colorants that can be used include C. I. Pigment Blue (1, 7, 15, 15:1, 15:2, 15:3, 15:4, 60, 62, and 66), Phthalocyanine Blue, C. I. Vat Blue, and C. I. Acid Blue.

(Releasing Agent)

The toner cores may contain a releasing agent. The releasing agent is for example used in order to impart offset resistance to the toner. In terms of imparting sufficient offset resistance to the toner, the releasing agent is preferably contained in an amount of at least 1 part by mass and no greater than 20 parts by mass relative to 100 parts by mass of the binder resin.

Examples of releasing agents that can be preferably used include: aliphatic hydrocarbon-based waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon-based waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozocerite, ceresin, and petrolatum; waxes having a fatty acid ester as major component such as montanic acid ester wax and castor wax; and waxes in which a part or all of a fatty acid ester has been deoxidized such as deoxidized carnauba wax.

A compatibilizer may be added to the toner cores containing a releasing agent in order to improve compatibility between the binder resin and the releasing agent.

(Charge Control Agent)

The toner cores may contain a charge control agent. The charge control agent is for example used in order to provide a toner having further improved charge stability and an improved charge rise characteristic. The charge rise characteristic of the toner is an indicator as to whether the toner can be charged to a specific charge level in a short period of time. The cationic strength of the toner cores can be increased through the toner cores containing a positively chargeable charge control agent.

Examples of positively chargeable charge control agents that can be used include azine compounds such as pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes such as Azine Fast Red FC, Azine Fast Red 12BK, Azine Violet BO, Azine Brown 3G, Azine Light Brown GR, Azine Dark Green BH/C, Azine Deep Black EW, and Azine Deep Black 3RL; acid dyes such as Nigrosine BK, Nigrosine NB, and Nigrosine Z; metal salts of naphthenic acids; metal salts of higher organic carboxylic acids; alkoxylated amines; alkylamides; and quaternary ammonium salts such as benzyldecylhexylmethyl ammonium chloride, decyltrimethyl ammonium chloride, 2-(methacryloyloxy)ethyltrimethylammonium chloride, and dimethylaminopropyl acrylamide methyl chloride quaternary salt.

In terms of providing a toner having further improved charge stability, the charge control agent is preferably contained in an amount of at least 0.1 parts by mass and no greater than 10 parts by mass relative to 100 parts by mass of the binder resin.

(Magnetic Powder)

The toner cores may contain a magnetic powder. Examples of materials of the magnetic powder that can be used include ferromagnetic metals (specific examples include iron, cobalt, and nickel) and alloys thereof, ferromagnetic metal oxides (specific examples include ferrite, magnetite, and chromium dioxide), and materials subjected to ferromagnetization (specific examples include carbon materials made ferromagnetic through thermal treatment).

[Shell Layer]

The shell layers for example contain a shell resin as a main component. Preferably, the shell layers are layers substantially composed of the shell resin (for example, layers containing at least 90% by mass of the shell resin). More preferably, the shell layers are layers only containing the shell resin. The shell resin may be the same resin as in the first copolymer contained in the second surface treatment layers of the silica particles. Resins that can be used as the shell resin differ from the first copolymer in the following points. That is, the resins that can be used as the shell resin do not need to include the second repeating unit. The resins that can be used as the shell resin may include the second repeating unit. In such a case, however, the asterisk in general formula (II) does not represent a site that is bonded to an atom in the carboxy-modified silicone oil but represents a site that is bonded to an atom in the binder resin.

In terms of forming high-quality images, the shell layers preferably have a thickness of at least 10 nm and no greater than 100 nm.

Second Embodiment: Toner Production Method

A second embodiment of the present disclosure relates to a method for producing a toner including toner particles each including a toner mother particle and an external additive adhering to a surface of the toner mother particle. The method includes a process of surface-treating silica bases with a carboxy-modified silicone oil (a first surface treatment process), a process of surface-treating the silica bases, which have been surface-treated with the carboxy-modified silicone oil, with the second copolymer including the first repeating unit represented by general formula (I) to prepare silica particles (a second surface treatment process), and a process of causing an external additive including the silica particles to adhere to the surfaces of the toner mother particles (an external additive addition process). The silica particles have a non-ring-opened oxazoline group content of at least 1 μmol/g and no greater than 500 μmol/g as measured by gas chromatography-mass spectrometry.

The toner production method according to the second embodiment can provide the toner according to the first embodiment. The toner, the toner mother particles, the external additive, the toner particles, the silica particles, the silica bases, and the carboxy-modified silicone oil in the second embodiment are as described for the first embodiment. As such, description thereof will be omitted for the second embodiment to avoid redundancy.

[Preparation of Toner Mother Particles]

The following first describes a method for preparing the toner mother particles for use in the present embodiment. The toner cores may be used as is as the toner mother particles, or toner cores covered with the shell layers may be used as the toner mother particles.

No particular limitations are placed on the method for preparing the toner cores, and a known pulverization method or a known aggregation method may be employed. Preferably, the toner cores are prepared by a pulverization method.

The toner mother particles each including a toner core and a shell layer covering the toner core can be formed for example by mixing the toner cores and a shell layer forming liquid.

The shell layer forming liquid contains a vinyl resin for shell layer formation (a shell layer formation vinyl resin). The shell layer formation vinyl resin for example includes the first repeating unit. "EPOCROS (registered Japanese trademark) WS-300" or "EPOCROS (registered Japanese trademark) WS-700", which are products of Nippon Shokubai Co., Ltd., can for example be used as a solution of the shell layer formation vinyl resin. The EPOCROS (registered Japanese trademark) WS-300 contains a copolymer of 2-vinyl-2-oxazoline and methyl methacrylate (a water-soluble cross-linking agent). A mass ratio between the monomers forming the copolymer is (2-vinyl-2-oxazoline):(methyl methacrylate)=9:1. The EPOCROS (registered Japanese trademark) WS-700 contains a copolymer of 2-vinyl-2-oxazoline, methyl methacrylate, and butyl acrylate (a water-soluble cross-linking agent). A mass ratio between the monomers forming the copolymer is (2-vinyl-2-oxazoline):(methyl methacrylate):(butyl acrylate)=5:4:1. The 2-vinyl-2-oxazoline is a compound represented by formula (A-1) shown below.

(A-1)

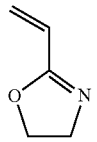

The following describes a method for mixing the toner cores and the shell layer forming liquid in detail using an example in which the shell layer formation vinyl resin includes the first repeating unit and carboxy groups exist in a reaction system (for example, where carboxy groups exist in the binder resin or where carboxylic acid is added). Preferably, the toner cores and the shell layer forming liquid are mixed under heating at a temperature higher than or equal to a temperature at which oxazoline groups and carboxy groups react with each other to form amide bonds (also referred to below as a first temperature). Through the mixing, the shell layers are formed. That is, a dispersion of the toner mother particles each having the toner core and the shell layer covering the toner core is obtained. The toner mother particles can be obtained through solid-liquid separation, washing, and drying of the dispersion obtained as described above.

More specifically, a dispersion is first prepared by mixing the toner cores and the shell layer forming liquid. The material of the shell layer (shell material) adheres to the surfaces of the toner cores in the dispersion. In terms of uniform adhesion of the shell material to the surfaces of the toner cores, a high degree of dispersion of the toner cores is preferably achieved in the dispersion.

Next, the dispersion is heated under stirring up to the first temperature at a specific heating rate. Thereafter, the dispersion is kept at the first temperature under stirring for a specific stirring time. As described above, the first temperature is higher than or equal to a temperature at which oxazoline groups and carboxy groups react with each other to form amide bonds. It is therefore thought that some of the oxazoline groups in the molecules of the shell layer formation vinyl resin react with the carboxy groups while the dispersion is kept at the first temperature.

Preferably, the first temperature is at least 50° C. and no greater than 100° C. The first temperature being at least 50° C. promotes the reaction between the oxazoline groups and the carboxy groups. The first temperature being at least 50° C. also allows the shell material to readily cure on the surfaces of the toner cores. The first temperature being no greater than 100° C. enables the toner cores to be dispersed well in the dispersion. As long as the toner cores are dispersed well in the dispersion, the toner cores do not easily agglomerate in the dispersion, allowing the shell material to adhere to the surfaces of the toner cores in a uniform manner.

Preferably, the heating rate is at least 0.1° C./minute and no greater than 3.0° C./minute. Preferably, the stirring time is at least 30 minutes and no greater than 4 hours. Preferably, the stirring is performed at a rotational speed of at least 50 rpm and no greater than 500 rpm. The heating and the stirring under the above-described conditions promote the reaction between the oxazoline groups and the carboxy groups.

Preferably, the dispersion (the dispersion containing the toner cores and the shell layer forming liquid) further contains at least one of a basic substance and a ring-opening agent. The amount of non-ring-opened oxazoline groups can be adjusted by changing the amount of the basic substance and the amount of the ring-opening agent. More specifically, the amount of the non-ring-opened oxazoline groups tends to increase with an increase in the amount of the basic substance in the dispersion. As a result of the dispersion further containing a basic substance, the carboxy groups are expected to be readily neutralized with the basic substance to retard a ring-opening reaction of the oxazoline groups. The amount of the non-ring-opened oxazoline groups tends to decrease with an increase in the amount of the ring-opening agent in the dispersion. This is because the ring-opening agent promotes the ring-opening reaction of the oxazoline groups.

The basic substance is preferably ammonia or sodium hydroxide.

Preferably, the ring-opening agent is a short-chain fatty acid, more preferably a carboxylic acid represented by $R^{30}$—COOH ($R^{30}$ represents an alkyl group having a carbon number of at least 1 and no greater than 3), and still more preferably acetic acid or propionic acid.

Preferably, the ring-opening agent is water-soluble. As a result of the ring-opening agent being water-soluble, the ring-opening agent is readily dissolved in an aqueous medium in the shell layer formation to facilitate ring-opening of the oxazoline groups in the shell resin. Since $R^{30}$ is an alkyl group having a carbon number of at least 1 and no greater than 3, the carboxylic acid represented by $R^{30}$—COOH is highly water-soluble.

[Preparation of Silica Particles]

The toner production method according to the second embodiment includes preparation of silica particles through the first and second surface treatment processes.

[First Surface Treatment Process]

In this process, silica bases are surface-treated with a carboxy-modified silicone oil. Through the above, the first surface treatment layers covering the surfaces of the respective silica bases are formed. It is preferable to perform the first surface treatment process using only the carboxy-modified silicone oil, but another material may be used together with the carboxy-modified silicone oil.

Examples of specific surface treatment methods include a method in which water is sprayed onto the silica bases under stirring under an inert atmosphere (for example, a nitrogen atmosphere), the carboxy-modified silicone oil is sprayed onto the silica bases, and then the silica bases are heated. The heating is for example carried out under conditions of a heating temperature of at least 200° C. and no greater than 300° C. and a heating time of at least 30 minutes and no greater than 5 hours.

[Second Surface Treatment Process]

In this process, the silica bases surface-treated with the carboxy-modified silicone oil are further surface-treated with the second copolymer including the first repeating unit represented by general formula (I), thereby yielding silica particles. Specifically, the first surface treatment layers formed on the silica bases are respectively covered with the second surface treatment layers. Only the second copolymer may be used in the second surface treatment process, or another material may be used together with the second copolymer.

Examples of specific surface treatment methods include a method in which a surface treatment agent obtained by dispersing the second copolymer in water is mixed with the silica bases subjected to the first surface treatment process to cause a reaction. Detailed conditions for the mixing can be the same as described for the mixing of the toner cores and the shell layer forming liquid.

A base may be added to the dispersion (the dispersion containing the surface treatment agent and the silica bases subjected to the first surface treatment process). In such a situation, the amount of the base may for example be at least 0.01 parts by mass and no greater than 0.20 parts by mass relative to 100 parts by mass of the silica bases subjected to the first surface treatment process.

A ring-opening agent may be added to the dispersion (the dispersion containing the surface treatment agent and the silica bases subjected to the first surface treatment process). In such a situation, the amount of the ring-opening agent may for example be at least 0.5 parts by mass and no greater than 20 parts by mass relative to 100 parts by mass of the silica bases subjected to the first surface treatment process. Preferably, the amount of the ring-opening agent is at least 0.5 parts by mass and no greater than 5 parts by mass.

Some of the first repeating units in the molecules of the second copolymer form the second repeating units or the fourth repeating units through the second surface treatment process. That is, some of the oxazoline groups of the first repeating units in the molecules of the second copolymer react with the carboxy groups of the carboxy-modified silicone oil contained in the first surface treatment layers to form the second repeating units. In a situation in which a ring-opening agent is used in the second surface treatment process, some of the oxazoline groups of the first repeating units in the molecules of the second copolymer react with the ring-opening agent to form the fourth repeating units. Thus, the first copolymer is formed from the second copolymer.

A non-ring-opened oxazoline group has relatively strong positive chargeability. An non-ring-opened oxazoline group goes through ring-opening to form an amide bond through a reaction with a carboxy group. An oxazoline group having gone through ring-opening and formed an amide bond has weaker positive chargeability than a non-ring-opened oxazoline group. Accordingly, the non-ring-opened oxazoline group content of the second surface treatment layer can be adjusted by adjusting the type and the amount of the carboxy-modified silicone oil to be used in the first surface treatment process, and the type and the amount of the ring-opening agent to be used in the second surface treatment process.

[External Additive Addition Process]

In this process, an external additive is caused to adhere to the surfaces of the toner mother particles. Through the above, toner particles each including a toner mother particle and an external additive adhering to the surface of the toner mother particle are obtained. No particular limitations are placed on the method for causing the external additive to adhere to the surfaces of the toner mother particles. Examples thereof include a method in which the toner mother particles and the external additive are stirred using a mixer or the like.

EXAMPLES

The following describes the present disclosure in further detail using Examples. However, the present disclosure is not in any way limited by the scope of Examples.

<Toner Production Method>

Toners according to Examples and Comparative Examples were produced according to methods described below.

[Preparation of Toner Mother Particles]

Toner mother particles each including a toner core and a shell layer were obtained as described below. First, a polyester resin to be used for the toner cores was synthesized.

(Synthesize of Polyester Resin)

A four-necked flask was used as a reaction vessel for synthesis of a polyester resin. The four-necked flask was a reaction vessel having a capacity of 5 L and equipped with a thermometer, a nitrogen inlet tube, a drainage tube, a rectification column, a stirring impeller, and a thermocouple. The reaction vessel was set up in an oil bath. Subsequently, the reaction vessel was charged with 1,250 g of propanediol, 1,720 g of terephthalic acid, and 3 g of tin(II) dioctoate as an esterification catalyst. Subsequently, the internal temperature of the reaction vessel was increased up to 220° C. using the oil bath. The internal temperature of the reaction vessel was kept at 220° C., and the reaction vessel contents were caused to undergo a condensation reaction for 15 hours under a nitrogen atmosphere. The internal pressure of the reaction vessel was adjusted to 8.0 kPa while the internal temperature of the reaction vessel was kept at 220° C. Under such conditions, the condensation reaction was continued until a reaction product (polyester resin) having a desired softening point was obtained. Thus, a polyester resin A was obtained. The polyester resin A had a Tm of 88° C.

(Preparation of Toner Cores)

An FM mixer ("FM-20B", product of Nippon Coke & Engineering Co., Ltd.) was charged with 82.0 parts by mass of the polyester resin A as a binder resin, 9.0 parts by mass of ester wax ("NISSAN ELECTOL (registered Japanese trademark) WEP-3", product of NOF Corporation) as a releasing agent, and 9.0 parts by mass of carbon black ("MA100", product of Mitsubishi Chemical Corporation) as a colorant. The mixer contents were mixed at a rotational speed of 2,000 rpm over 4 minutes.

The resultant mixture was melt-kneaded using a twin-screw extruder ("PCM-30", product of Ikegai Corp.) under conditions of a material feeding speed of 8 kg/hour, a shaft rotational speed of 130 rpm, and a set temperature (cylinder temperature) of 110° C. The resultant melt-kneaded product was cooled. After the cooling, the melt-kneaded product was coarsely pulverized using a pulverizer ("ROTOPLEX (registered Japanese trademark), product of Hosokawa Micron Corporation) under a condition of a set particle diameter of no greater than 2 mm. The resultant coarsely pulverized product was finely pulverized using a pulverizer ("TURBO MILL Type RS", product of Freund-Turbo Corporation). The resultant finely pulverized product was classified using a classifier ("ELBOW JET Type EJ-LABO", product of Nittetsu Mining Co., Ltd.). Through the above, toner cores having a volume median diameter ($D_{50}$) of 6 μm were obtained. The thus obtained toner cores had a softening point (Tm) of 89° C. and a glass transition point (Tg) of 48° C.

(Shell Formation)

A three-necked flask (capacity: 1 L) equipped with a thermometer and a stirring impeller was charged with 300 mL of ion exchanged water. The flask was set up in a water bath, and the internal temperature of the flask was kept at 30° C. using the water bath. A specific amount of an aqueous solution of an oxazoline group-containing polymer ("EPOCROS (registered Japanese trademark) WS-300", product of Nippon Shokubai Co., Ltd., solid concentration: 10% by mass) was added into the flask, and the flask contents were stirred at a rotational speed of 200 rpm over 1 hour. Into the flask, 300.0 g of the toner cores were added, and the flask contents were stirred at a rotational speed of 200 rpm over 1 hour. Note that the amount of the aqueous solution of an oxazoline group-containing polymer was determined so as to give an oxazoline group-containing resin amount of 1% by mass relative to the amount of the toner cores.

Next, 300 mL of ion exchanged water and 6 mL of an aqueous ammonia solution (concentration: 1% by mass) were added into the flask. The internal temperature of the flask was increased up to 60° C. at a heating rate of 0.5° C./minute while the flask contents were stirred at a rotational speed of 150 rpm. During the heating, approximately 0.2 mL of acetic acid was added to the reaction liquid. The flask contents were stirred at a rotational speed of 100 rpm over 1 hour while the internal temperature of the flask was kept at 60° C. Thereafter, the internal temperature of the flask was cooled to room temperature. Through the above, a toner mother particle-containing dispersion was obtained.

(Washing of Toner Mother Particles)

The toner mother particle-containing dispersion obtained as described above was subjected to suction filtration using a Buchner funnel. The thus collected wet cake of the toner mother particles was dispersed in ion exchanged water. The resultant dispersion was subjected to suction filtration using a Buchner funnel. Such solid-liquid separation was repeated five times.

(Drying of Toner Mother Particles)

The toner mother particles obtained through the solid-liquid separation were dispersed in an aqueous ethanol solution (concentration: 50% by mass). As a result, a slurry of the toner mother particles was obtained. The toner mother particles in the slurry were dried using a continuous type surface modifier ("COATMIZER" (registered Japanese trademark)", product of Freund Corporation) under conditions of a hot air flow temperature of 45° C. and a blower flow rate of 2 $m^3$/minute. Through the above, a powder including the toner mother particles was obtained.

[Production of Silica Particles]

Silica particles (A-1) to (A-6) and (B-1) to (B-5) were each prepared according to a method described below.

(First Surface Treatment Process)

A four-necked flask equipped with a thermometer, a stirring impeller, and a cooler was charged with 50 g of hydrophilic fumed silica particles ("AEROSIL (registered Japanese trademark) 90G", product of Nippon Aerosil Co., Ltd., number average primary particle diameter: approximately 20 nm). Nitrogen was introduced into the flask, and thus the flask was purged with nitrogen. Water was sprayed into the flask while the flask contents were stirred. Thereafter, a carboxy-modified silicone oil or a silane coupling agent of type and in an amount as shown in Table 1 was sprayed into the flask while the flask contents were continuously stirred. A reaction was caused at 250° C. for 2 hours, and then the cooler was removed. Subsequently, alcohol was removed together with nitrogen gas under heating at 250° C.

Through the above, silica bases each covered with a first surface treatment layer were obtained.

The following carboxy-modified silicone oils and silane coupling agents were used.

Silane coupling agent a: KBE-903 (product of Shin-Etsu Chemical Co., Ltd.)

Silane coupling agent b: KBM-3033 (product of Shin-Etsu Chemical Co., Ltd.)

Carboxy-modified silicone oil A: X-22-3710 (Shin-Etsu Chemical Co., Ltd.)

Carboxy-modified silicone oil B: X-22-162C (Shin-Etsu Chemical Co., Ltd.)

Carboxy-modified silicone oil C: X-22-3701E (Shin-Etsu Chemical Co., Ltd.)

Note that the silane coupling agent A contained 3-aminopropyltrimethoxysilane. The silane coupling agent B contained n-propyltrimethoxysilane. The carboxy-modified silicone oil A included a carboxy-modified silicone oil having a carboxy group at a side chain. The carboxy-modified silicone oil B included a carboxy-modified silicone oil having a carboxy group at one end. The carboxy-modified silicone oil C included a carboxy-modified silicone oil having a carboxy group at both ends.

A three-necked flask (capacity: 1 L) equipped with a thermometer and a stirring impeller was charged with ion exchanged water and an aqueous polymer solution of type and in an amount as shown in Table 1 to prepare a solution in a total amount of 300 g. The aqueous polymer solution contained the second copolymer as a material of the second surface treatment layer. While the internal temperature of the flask was kept at 30° C. using a water bath, 50 g of the silica bases covered with the first surface treatment layers were added into the flask, and the flask contents were stirred at a speed of 200 rpm for 1 hour. Next, 200 g of ion exchanged water was added into the flask. Furthermore, 6 mL of a 1% by mass aqueous ammonia solution was added into the flask, and the internal temperature of the flask was increased up to 80° C. at a rate of 1.0° C./minute while the flask contents were stirred at 150 rpm. Note that in the preparation of the silica particles (A-6), 1 g of acetic acid was added during the heating to adjust the ring-opening oxazoline group content. That is, the acetic acid was added to cause ring-opening of oxazoline groups. After the heating, the flask contents were further stirred at 100 rpm at 80° C. for 1 hour. Thereafter, an aqueous ammonia solution (concentration: 1% by mass) was added into the flask to adjust the flask contents to pH 7. The flask contents were then cooled to room temperature. Through the above, a silica particle-containing dispersion was obtained.

The following aqueous polymer solutions were used.

Aqueous polymer solution A: "EPOCROS (registered Japanese trademark) WS-700", product of Nippon Shokubai Co., Ltd., solid concentration: 25% by mass Aqueous polymer solution B: "EPOCROS (registered Japanese trademark) WS-300", product of Nippon Shokubai Co., Ltd., solid concentration: 10% by mass (Washing of Silica Particles)

The silica particle-containing dispersion obtained as described above was subjected to suction filtration using a Buchner funnel. The thus collected wet cake of the silica particles was dispersed in ion exchanged water. The resultant dispersion was subjected to suction filtration using a Buchner funnel. Such solid-liquid separation was repeated three times.

(Drying of Silica Particles)

The silica particles obtained through the solid-liquid separation were dispersed in an aqueous ethanol solution (concentration: 50% by mass). As a result, a slurry of the silica particles was obtained. The silica particles in the slurry were dried using a continuous type surface modifier ("COATMIZER" (registered Japanese trademark)", product of Freund Corporation) under conditions of a hot air flow temperature of 45° C. and a blower flow rate of 2 $m^3$/minute. Through the above, a powder including the silica particles was obtained.

As described above, the silica particles (A-1) to (A-8) and (B-1) to (B-5) were each prepared.

(Non-Ring-Opened Oxazoline Group Content)

The non-ring-opened oxazoline group content of the silica particles (A-1) to (A-8) and (B-1) to (B-5) was measured. Specifically, quantitative analysis by gas chromatography-mass spectrometry (GC/MS) was carried out under the following conditions using a calibration curve based on standard substances. Table 1 shows measurement results.

(GC/MS)

A gas chromatograph mass spectrometer ("GCMS-QP2010 Ultra", product of Shimadzu Corporation) and a multi-shot pyrolyzer ("FRONTIER LAB MULTI-FUNCTIONAL PYROLYZER (registered Japanese trademark) PY-3030D", product of Frontier Laboratories Ltd.) were used as measuring devices. A GC column ("AGILENT (registered Japanese trademark) J&W Ultra-inert Capillary GC Column DB-5ms", product of Agilent Technologies Japan, Ltd., phase: allylene phase having a polymer main chain strengthened by introducing allylene to siloxane polymer, inner diameter: 0.25 mm, film thickness: 0.25 μm, length: 30 m) was used.

(Gas Chromatography)

Carrier gas: Helium (He) gas

Carrier flow rate: 1 mL/minute

Vaporizing chamber temperature: 210° C.

Thermal decomposition temperature: 600° C. in heating furnace, 320° C. in interface portion Heating condition: Temperature kept at 40° C. for 3 minutes, increased from 40° C. to 300° C. at a rate of 10° C./minute, and kept at 300° C. for 15 minutes (Mass Spectrometry)

Ionization method: Electron impact (EI) method

Ion source temperature: 200° C.

Interface portion temperature: 320° C.

Detection mode: Scan (measurement range: from 45 m/z to 500 m/z)

[Toner Evaluation Methods]

With respect to the silica particles, the presence of a specific covalent bond in the second repeating units or the fourth repeating units was confirmed through measurement using a Fourier-transform infrared spectrometer (FT-IR). Table 1 shows measurement results.

<Confirmation of Presence of Specific Covalent Bond>

"FRONTIER", product of PerkinElmer Japan Co., Ltd. was used as the Fourier-transform infrared spectrometer (FT-IR). An accessory "UNIVERSAL ATR", product of PerkinElmer Japan Co., Ltd. was attached to the FRONTIER. The measurement was carried out in an attenuated total reflection (ATR) mode. The background was measured using the measuring device under the following conditions.

Measurement range: 4,000 $cm^{-1}$ to 400 $cm^{-1}$

Resolution: 4.0 $cm^{-1}$

Number of scans: 16

Subsequently, an FT-IR spectrum (horizontal axis: wavenumber of irradiated infrared rays, vertical axis: absorbance) of the silica particles was measured using the measuring device. On the thus obtained IR spectrum, the presence or absence of a peak in a range of from 1,650 $cm^{-1}$ to 1,515

$cm^{-1}$, which is a peak of C═O stretching in amide bonds, was confirmed. The silica particles were determined to have the specific covalent bond formed through a reaction between carboxy groups and oxazoline groups if the presence of the C═O stretching peak was confirmed. That is, in such a case, the silica particles were determined to contain a polymer including the second repeating unit or the fourth repeating unit.

[Mixing]

An FM mixer ("FM-10B", product of Nippon Coke & Engineering Co., Ltd.) was used to mix 100 parts by mass of the toner mother particles and external additives for 5 minutes under conditions of a rotational speed of 3,000 rpm and a jacket temperature of 20° C. As the external additives, 1.8 parts by mass of silica particles of type as shown in Table 1 and 1.5 parts by mass of fine conductive titanium oxide particles ("EC-100", product of Titan Kogyo, Ltd.) were used. Through the above, toners (TA-1) to (TA-8) of Examples 1 to 8 and toners (TB-1) to (TB-5) of Comparative Examples 1 to 5 were obtained.

In Table 1, "g" under "Silane coupling agent" means a solid equivalent value. In Table 1, "g" under "Aqueous polymer solution" means a total mass including a mass of a solvent.

TABLE 1

| | | Surface treatment | | | | | | | | Analysis result | |
|---|---|---|---|---|---|---|---|---|---|---|---|
| | | First surface treatment layer | | | | | Second surface treatment layer | | | | |
| | | Carboxy-modified silicone oil | | | Silane coupling agent | | Aqueous polymer solution | | Ring-opening agent Acetic acid | Non-ring-opened oxazoline group | |
| Toner | Silica particles | A [g] | B [g] | C [g] | a [g] | b [g] | A [g] | B [g] | [g] | content [μmol/g] | Specific covalent bond |
| TA-1 | A-1 | 2 | 0 | 0 | 0 | 0 | 20 | 0 | 0 | 21.0 | Present |
| TA-2 | A-2 | 2 | 0 | 0 | 0 | 0 | 40 | 0 | 0 | 172.0 | Present |
| TA-3 | A-3 | 2 | 0 | 0 | 0 | 0 | 60 | 0 | 0 | 450.0 | Present |
| TA-4 | A-4 | 4 | 0 | 0 | 0 | 0 | 60 | 0 | 0 | 284.0 | Present |
| TA-5 | A-5 | 2 | 0 | 0 | 0 | 0 | 0 | 50 | 0 | 402.0 | Present |
| TA-6 | A-6 | 2 | 0 | 0 | 0 | 0 | 60 | 0 | 1 | 372.0 | Present |
| TA-7 | A-7 | 0 | 2 | 0 | 0 | 0 | 60 | 0 | 0 | 321.0 | Present |
| TA-8 | A-8 | 0 | 0 | 2 | 0 | 0 | 60 | 0 | 0 | 221.0 | Present |
| TB-1 | B-1 | 0 | 0 | 0 | 0 | 0 | 40 | 0 | 0 | 480.0 | Absent |
| TB-2 | B-2 | 2 | 0 | 0 | 0 | 0 | 8 | 0 | 0 | 0.5 | Present |
| TB-3 | B-3 | 2 | 0 | 0 | 0 | 0 | 80 | 0 | 0 | 721.0 | Present |
| TB-4 | B-4 | 0 | 0 | 0 | 5 | 5 | 0 | 0 | 0 | 0.0 | Absent |
| TB-5 | B-5 | 6 | 0 | 0 | 0 | 0 | 20 | 0 | 0 | 0.3 | Present |

<Evaluation>

Anti-fogging performance, thermal-stress resistance, and charge stability of the toners of Examples 1 to 8 and Comparative Examples 1 to 5 were evaluated according to methods described below. Specifically, with respect to each of the toners, fogging density, aggregation rate after aging, and charge decay constant were measured. The fogging density was measured under three different conditions.

[Fogging Density A]

With respect to each of the toners (TA-1) to (TA-8) and (TB-1) to (TB-5), 10 parts by mass of the toner and 100 parts by mass of a carrier (a carrier for "TASKALFA (registered Japanese trademark) 5550ci", product of KYOCERA Document Solutions Inc.) were mixed over 30 minutes using a ball mill. Through the above, an evaluation target was obtained.

The evaluation target was loaded into a container section of a black-color developing device of a multifunction peripheral ("TASKALFA (registered Japanese trademark) 5550ci", product of KYOCERA Document Solutions Inc.). The toner (specifically, an appropriate one of the toners (TA-1) to (TA-8) and (TB-1) to (TB-5)) was loaded into a black-color toner container of the multifunction peripheral. This multifunction peripheral was used as an evaluation apparatus.

An image (coverage: 5%) was printed on 4,000 successive sheets of plain paper (A4 size) using the evaluation apparatus under environmental conditions of a temperature of 10° C. and a relative humidity of 10%. Next, an evaluation image (coverage: 20%) was printed on 500 successive sheets of plain paler (A4 size) using the evaluation apparatus under environmental conditions of a temperature of 10° C. and a relative humidity of 10%. Thus, 500 sheets of evaluation images were obtained. The evaluation images each included a solid image portion and a blank portion (a region not printed on).

A whiteness meter ("TC-6DS/A", product of Tokyo Denshoku CO., LTD.) was used to measure a reflection density of the blank portion of each evaluation image. The fogging density (FD) was calculated in accordance with an expression shown below. The fogging density (FD) of all of the evaluation images obtained was calculated as described above. An average of the values of the fogging density (FD) was calculated and taken to be an evaluation value.

FD=(reflection density of blank portion)−(reflection density of unprinted paper)

The fogging density (FD) was evaluated in accordance with the following evaluation standard.

Excellent: Evaluation value ≤0.010

Bad: Evaluation value >0.010

[Fogging Density B]

Each evaluation target and an evaluation apparatus were obtained in the same manner as in the evaluation of the fogging density A. An image (coverage: 1%) was printed on 10,000 successive sheets of plain paper (A4 size) using the evaluation apparatus under environmental conditions of a temperature of 32.5° C. and a relative humidity of 80%. Next, an evaluation image (coverage: 20%) was printed on 500 successive sheets of plain paler (A4 size) using the evaluation apparatus under environmental conditions of a temperature of 32.5° C. and a relative humidity of 80%. Thus, 500 sheets of evaluation images were obtained. The evaluation images each included a solid image portion and a blank portion (a region not printed on).

The fogging density (FD) was calculated in the same manner as in the evaluation of the fogging density A. The fogging density (FD) was evaluated in accordance with the following evaluation standard.

Excellent: Evaluation value ≤0.010

Bad: Evaluation value >0.010

[Fogging Density C]

Each evaluation target and an evaluation apparatus were obtained in the same manner as in the evaluation of the fogging density A. The evaluation apparatus was left to stand for 24 hours under environmental conditions of a temperature of 32.5° C. and a relative humidity of 80%. Thereafter, an evaluation image (coverage: 20%) was printed on 10 successive sheets of plain paler (A4 size) using the evaluation apparatus under environmental conditions of a temperature of 32.5° C. and a relative humidity of 80%. Thus, 10 sheets of evaluation images were obtained. The evaluation images each included a solid image portion and a blank portion (a region not printed on).

The fogging density (FD) was calculated in the same manner as in the evaluation of the fogging density A except the following point. Specifically, in the evaluation of the fogging density A, the average of the values of the fogging density (FD) was taken to be the evaluation value. In the evaluation of the fogging density C, however, a largest value of the values of the fogging density (FD) of the evaluation images was taken to be an evaluation value. The fogging density (FD) was evaluated in accordance with the following evaluation standard.

Excellent: Evaluation value ≤0.010

Bad: Evaluation value >0.010

[Aggregation Rate]

With respect to each of the toners (TA-1) to (TA-8) and (TB-1) to (TB-5), 10 parts by mass of the toner and 100 parts by mass of a carrier (a carrier for "TASKALFA (registered Japanese trademark) 500ci", product of KYOCERA Document Solutions Inc.) were mixed over 30 minutes using a ball mill. Thus, an evaluation target was obtained.

The evaluation target was loaded into a container section of a black-color developing device of a multifunction peripheral ("TASKALFA (registered Japanese trademark) 500ci", product of KYOCERA Document Solutions Inc.). An evaluation apparatus was prepared as described above.

The developing device was removed from the evaluation apparatus and left to stand in a thermostatic chamber (set temperature: 50° C.) for 1 hour. The evaluation target in the developing device was stirred using an external motor over 1 hour while the developing device was kept in the thermostatic chamber. The stirring in the developing device was controlled by the external motor so as to match the driving speed of the developing device of the evaluation apparatus. Thereafter, the evaluation target was taken out of the developing device.

Next, 10 g of the evaluation target taken out of the developing device was placed on a 200-mesh sieve (pore size 75 μm) of known mass. A total mass of the sieve and the evaluation target thereon was measured to determine a mass of the evaluation target on the sieve (a mass of the evaluation target before sifting). Next, the sieve was placed in "POWDER TESTER (registered Japanese trademark) PT-X", product of Hosokawa Micron Corporation and shaken at an amplitude of 1.0 mm for 60 seconds in accordance with a manual of the POWDER TESTER (registered Japanese trademark) PT-X. Thus, the evaluation target was sifted. After the sifting, a mass of the evaluation target that did not pass through the sieve was measured. The aggregation rate (unit: %) of the evaluation target was calculated based on the mass of the evaluation target before sifting and the mass of the evaluation target after sifting in accordance with an expression shown below. Note that the "mass of evaluation target after sifting" in the expression is the mass of the evaluation target that did not pass through the sieve, that is, the mass of the evaluation target remaining on the sieve after sifting.

Aggregation rate=100×mass of evaluation target after sifting/mass of evaluation target before sifting The aggregation rate was evaluated in accordance with the following evaluation standard.

Excellent: Aggregation rate ≤2%

Good: 2%<Aggregation rate ≤3%

Bad: Aggregation rate >3%

[Charge Decay Constant]

With respect to each of the toners (TA-1) to (TA-8) and (TB-1) to (TB-5), the charge decay constant of the toner was measured by a method in accordance with Japanese Industrial Standard (JIS) C61340-2-1-2006 using an electrostatic dissipation measuring device ("NS-D100", product of Nano Seeds Corporation). First, a sample (the toner) was added into a measurement cell. The measurement cell was a metal cell having a recess (internal diameter: 10 mm, depth: 1 mm). The sample was loaded into the recess of the cell by pressing on the sample from above using slide glass. Any of the sample that overflowed from the cell was removed by moving the slide glass back and forth on the surface of the cell. At least 0.04 g and no greater than 0.06 g of the sample was loaded into the cell.

The measurement cell having the sample loaded therein was grounded, and then placed in the electrostatic dissipation measuring device. The electrostatic dissipation measuring device was then left to stand for 12 hours under environmental conditions of a temperature of 32.5° C. and a relative humidity of 80%. Ions were supplied to the sample by corona discharge to charge the sample under the same environmental conditions. The charging time was 0.5 seconds. After 0.7 seconds elapsed from completion of the corona discharge, the surface potential of the sample was continuously measured. The charge decay constant (charge decay rate) a was calculated based on the measured surface potential in accordance with the following expression: $V=V_0 \cdot \exp(-\alpha\sqrt{t})$. In the expression, V represents surface potential [unit: V], $V_0$ represents initial surface potential [unit: V], and t represents decay time [unit: second].

The charge decay constant was evaluated in accordance with the following evaluation standard.

Excellent: Charge decay constant <0.030

Bad: Charge decay constant ≥0.030

TABLE 2

| | | Evaluation | | | | | |
|---|---|---|---|---|---|---|---|
| | | | | | | Charge decay | |
| | | Fogging density | | | Aggregation rate | Initial surface potential | Charge decay |
| | Toner | A | B | C | [%] | [+V] | constant |
| Example 1 | TA-1 | 0.002 | 0.003 | 0.003 | 1.5 | 1.054 | 0.013 |
| Example 2 | TA-2 | 0.002 | 0.004 | 0.005 | 1.6 | 1.066 | 0.017 |
| Example 3 | TA-3 | 0.002 | 0.003 | 0.008 | 1.5 | 1.021 | 0.026 |
| Example 4 | TA-4 | 0.001 | 0.003 | 0.003 | 1.2 | 1.032 | 0.020 |
| Example 5 | TA-5 | 0.002 | 0.004 | 0.004 | 1.6 | 1.045 | 0.022 |
| Example 6 | TA-6 | 0.001 | 0.003 | 0.004 | 1.3 | 1.042 | 0.021 |
| Example 7 | TA-7 | 0.003 | 0.005 | 0.004 | 1.7 | 1.032 | 0.020 |
| Example 8 | TA-8 | 0.003 | 0.006 | 0.004 | 1.8 | 1.056 | 0.018 |
| Comparative Example 1 | TB-1 | 0.003 | 0.012 | 0.008 | 1.5 | 1.001 | 0.028 |
| Comparative Example 2 | TB-2 | 0.005 | 0.006 | 0.005 | 3.6 | 1.052 | 0.020 |
| Comparative Example 3 | TB-3 | 0.002 | 0.004 | 0.014 | 2.1 | 0.954 | 0.045 |
| Comparative Example 4 | TB-4 | 0.011 | 0.025 | 0.012 | 1.7 | 1.045 | 0.012 |
| Comparative Example 5 | TB-5 | 0.002 | 0.003 | 0.011 | 1.6 | 0.972 | 0.034 |

Each of the toners (TA-1) to (TA-8) included toner particles each including a toner mother particle and an external additive adhering to the surface of the toner mother particle. The external additive included silica particles each including a silica base, a first surface treatment layer covering the silica base, and a second surface treatment layer covering the first surface treatment layer. The first surface treatment layer contained a carboxy-modified silicone oil, and the second surface treatment layer contained the first copolymer including the first repeating unit represented by general formula (I) and the second repeating unit represented by general formula (II). The silica particles had a non-ring-opened oxazoline group content of at least 1 μmol/g and no greater than 500 μmol/g as measured by gas chromatography-mass spectrometry.

As shown in Table 2, each of the toners (TA-1) and (TA-8) successfully restricted the fogging density (FD) to a desired level or lower even after the continuous printing. Each of the two-component developers respectively containing the toners (TA-1) to (TA-8) successfully had an aggregation rate restricted to a desired level or lower as measured after the two-component developers were subjected to stress at a high temperature for a specific period of time. Furthermore, each of the toners (TA-1) to (TA-8) successfully had a charge decay constant restricted to a desired level or lower.

By contrast, the toners (TB-1) to (TB-5) did not have the above-described features. Specifically, the toner (TB-1) is a comparative example having the silica particles (B-1) each including a silica base and a second surface treatment layer directly covering the silica base. The fogging density B of the toner (TB-1) was evaluated as bad. The reason for such a result is decided to be as follows. That is, the second surface treatment layers directly covering the respective silica bases exhibit insufficient adhesion to the silica bases, allowing detachment of the second surface treatment layers from the silica particles during printing. That is, the charge potential of the toner (TB-1) decreased due to detachment of the second surface treatment layers from the silica particles (B-1) during printing, causing fogging.

The toner (TB-2) is a comparative example including the silica particles (B-2) having a non-ring-opened oxazoline group content of less than 1 μmol/g. The aggregation rate of the toner (TB-2) was evaluated as bad. The reason for such a result is decided to be as follows. That is, silica particles having a non-ring-opened oxazoline group content of less than 1 μmol/g fail to impart sufficient hydrophobicity or sufficient positive chargeability to the surfaces of the toner particles. That is, the surfaces of the toner particles in the toner (TB-2) did not have sufficient hydrophobicity or sufficient positive chargeability, causing aggregation of the toner particles at a high temperature. Note that the fogging density of the toner (TB-2), which was not given sufficient positive chargeability by the external additive, was not bad. The reason for such a result is decided to be as follows. That is, fogging is usually caused due to a decrease in charge potential of a toner during printing, but the charge potential of the toner (TB-2) did not decrease during printing.

The toner (TB-3) is a comparative example including silica particles having a non-ring-opened oxazoline group content of greater than 500 μmol/g. The aggregation rate and the fogging density C of the toner (TB-3) were evaluated as bad. The reason for such a result is decided to be as follows. That is, a too large non-ring-opened oxazoline group content causes the surfaces of the toner particles to be hydrophilic. That is, the surfaces of the toner particles in the toner (TB-3) were hydrophilic, and therefore the charge potential of the toner decreased during printing. As a result, fogging occurred and the toner particles aggregated through the aging.

The toner (TB-4) was a comparative example including the silica particles (B-4) having a surface treatment layer formed using a silane coupling agent instead of silica particles having the first surface treatment layers and the second surface treatment layers. The fogging densities A to C of the toner (TB-4) were evaluated as bad. The reason for such a result is decided to be as follows. That is, a surface treatment layer formed using a silane coupling agent has insufficient durability. That is, the charge potential of the toner (TB-4) decreased due to detachment of the surface treatment layer of the silica particles (B-4) during printing, causing fogging.

The toner (TB-5) is a comparative example including the silica particles (B-5) having a non-ring-opened oxazoline group content of less than 1 μmol/g. The fogging density C and the charge decay constant of the toner (TB-5) were evaluated as bad. The reason for such a result is decided to be as follows. That is, silica particles having a non-ring-opened oxazoline group content of less than 1 μmol/g fail to impart sufficient hydrophobicity or sufficient positive chargeability to the surfaces of the toner particles. In particular, a relatively large amount of the carboxy-modified silicone oil was used for formation of the first surface treatment layers in the silica particles (B-5). As a result, the surfaces of the toner particles in the toner (TB-5) had relatively high hydrophilicity. Accordingly, the toner (TB-5) had relatively high hydrophilicity, and the charge potential thereof deceased during printing, causing image fogging.

What is claimed is:

1. A toner comprising toner particles each including a toner mother particle and an external additive adhering to a surface of the toner mother particle, wherein the external additive includes silica particles, the silica particles each include a silica base, a first surface treatment layer covering the silica base, and a second surface treatment layer covering the first surface treatment layer, the first surface treatment layer contains a carboxy-modified silicone oil, the second surface treatment layer contains a specific copolymer including a first repeating unit represented by general formula (I) shown below and a second repeating unit represented by general formula (II) shown below, and the silica particles have a non-ring-opened oxazoline group content of at least 1 μmol/g and no greater than 500 μmol/g as measured by gas chromatography-mass spectrometry, (I)

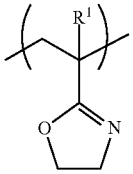

-continued (II)

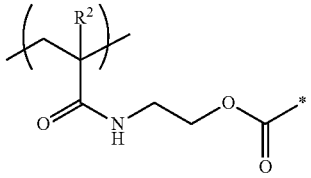

where in general formula (I), $R^1$ represents a hydrogen atom or an alkyl group having a carbon number of at least 1 and no greater than 10 and optionally substituted with a phenyl group, and in general formula (II), $R^2$ represents a hydrogen atom or an alkyl group having a carbon number of at least 1 and no greater than 10 and optionally substituted with a phenyl group, and an asterisk represents a site that is bonded to an atom in the carboxy-modified silicone oil.

2. The toner according to claim 1, wherein the silica particles are contained in an amount of at least 0.5 parts by mass and no greater than 5 parts by mass relative to 100 parts by mass of the toner mother particles.

3. The toner according to claim 1, wherein the silica particles have a non-ring-opened oxazoline group content of at least 20 μmol/g and no greater than 460 μmol/g.

4. The toner according to claim 1, wherein the specific copolymer further includes a third repeating unit derived from an alkyl (meth)acrylate.

* * * * *